United States Patent [19]

Shaw

[11] Patent Number: 4,944,057

[45] Date of Patent: Jul. 31, 1990

[54] PATIENT SUPPORT AND LIFTING DEVICE

[76] Inventor: Karen Shaw, R.D. #2, Oxford, N.Y. 13830

[21] Appl. No.: 413,709

[22] Filed: Sep. 28, 1989

[51] Int. Cl.[5] ..... A61G 1/00

[52] U.S. Cl. ..... 5/89; 294/140; 294/152; 224/159

[58] Field of Search ..... 5/81 R, 82, 89, 90; 294/140, 152, 156; 22H/157, 160

[56] References Cited

U.S. PATENT DOCUMENTS

| | | | |
|---|---|---|---|
| 869,325 | 10/1907 | Oehrmann | 5/81 R |
| 1,523,217 | 1/1925 | Juerges | 294/140 |
| 1,569,045 | 1/1926 | Sommer | 5/89 |
| 2,835,902 | 5/1958 | Fash | 5/82 |
| 3,254,815 | 6/1964 | Bugge | 224/159 |
| 3,859,677 | 1/1975 | Nordwig | 5/89 |
| 4,723,327 | 2/1988 | Smith | 5/89 |
| 4,782,539 | 11/1988 | Elliott | 294/140 |

FOREIGN PATENT DOCUMENTS

| | | | |
|---|---|---|---|
| 2834484 | 2/1980 | Fed. Rep. of Germany | 5/82 |
| 795357 | 5/1958 | United Kingdom | 5/82 |

*Primary Examiner*—Gary L. Smith
*Assistant Examiner*—F. Saether
*Attorney, Agent, or Firm*—Charles S. McGuire

[57] ABSTRACT

A device to assist in lifting and supporting a handicapped or infirm person from a sitting position on a supporting surface, and transferring the person to a sitting position on a second supporting surface. The device includes a main body portion of fabric or other flexible material having a configuration tending to conform naturally to the body contours of a person seated thereon. Flexible, strap-type handles are permanently installed on each side of the device and are selectively useable in either of two positions, providing relatively long and short, flexible handles; alternative, rigid handles are also provided. In a second embodiment, the body portion includes an elongated opening to permit the use of toilet facilities by a person seated on the device.

8 Claims, 3 Drawing Sheets

PATIENT SUPPORT AND LIFTING DEVICE

BACKGROUND OF THE INVENTION

The present invention relates to apparatus for assisting in lifting a physically handicapped or disabled person from a sitting position, and supporting the person while being transferred to a sitting position in a different location, as from a bedside to a chair, toilet, or the like, or vice versa.

Among the various types of apparatus and devices intended for lifting and supporting injured or infrim persons in a sitting position are those disclosed in U.S. Pat. Nos. 954,840, 1,849,864 and 2,015,391; U.S. Pat. No. 1,328,832 relates to similar structure intended for carrying infants or small children. U.S. Pat. No. 954,840 discloses a multi-purpose valise or traveling bag having a pair of handles which may be grasped by a person on each side to carry a person seated upon the unfolded, main body portion of the carrier. The folding seat of U.S. Pat. No. 1,849,864 includes a back support, as well as handle means on the sides of the seat portion and straps or loops on opposite sides of the back portion to encircle the arms or shoulders of the two individuals carrying the device with a person seated thereon.

A stretcher foldable into a chair-like position having seat and back portions for carrying by two persons on opposite sides is disclosed in U.S. Pat. No. 2,015,391. The baby carrier of U.S. Pat. No. 1,328,832 includes seat, back and side portions, as well as carrying handles on each side and a seat belt.

The devices of the patents discussed above are intended for carrying persons an appreciable distance by at least two other individuals, with the exception of the baby carrier of the last-mentioned patent, which assumes a small child of relatively little weight is being carried. They are neither intended nor suited for use by a single individual in lifting another adult from a sitting position on a bed, chair, or other support, for transfer to another, relatively nearby support.

It is a principal object of the present invention to provide a sling-type device which may easily be placed under an infirm or partially incapacitated adult in a sitting position in a first location, and used by a single individual to assist in lifting and transferring the infirm person to a second, nearby location.

A further object is to provide a patient support and lifting device which naturally conforms to the body contours of the person supported thereon.

Another object is to provide a device for placement under a person in a sitting position and having a plurality of selectively useable handle means on each side, one set of which is selectively adjustable between different positions, for use by either one or two individuals in lifting and supporting the person during transfer to another location.

A still further object is to provide a lifting and support device which permits a person seated thereon to be lifted from a seated position without producing undue muscular stress or strain in the individual performing the lifting.

Other objects will in part be obvious and will in part appear hereinafter.

SUMMARY OF THE INVENTION

In accordance with the foregoing objects, the invention contemplates a sling-type device having a generally rectangular main body portion of flexible material, such as a sturdy cloth fabric, having front, rear and side edges. Each of the side edges includes two portions which are folded over and stitched to themselves to provide two pockets, open at both ends, with a space therebetween. A predetermined length of nylon webbing, or similar material, is passed through both pockets on each side and attached to itself, providing permanent, flexible, strap-type handle means. The flexible handles may be grasped either at the upper portion only, or doubled upon itself by grasping both the portion in the space between the pockets and the upper portion together, when a shorter handle is desired.

An alternative, rigid handle means is provided by placing a wooden dowel, or other such rod, in the pockets on each side. The central portion of each rod is exposed in the space between the pockets on both sides to permit grasping of the rods. The flexible handle means, of course, remain in place but are normally not used when the rigid handle means are inserted.

The material of the body portion is gathered along the rear edge to a shorter length than the front edge. An elastic band having an unflexed length shorter than the length of the front edge may also be stitched into the rear edge, if desired. This forms a natural pocket around the lower back of a person seated on the main body portion, and the side portions also conform to body contours as the device is lifted. In an alternate embodiment, an elongated, central opening is provided in the main body portion, permitting the use of toilet facilities while on the device.

The foregoing and other features and advantages of the sling-type lifting and support device will be more apparent from the following detailed description, taken in conjunction with the accompanying drawings, wherein:

DETAILED DESCRIPTION

Figure 1:
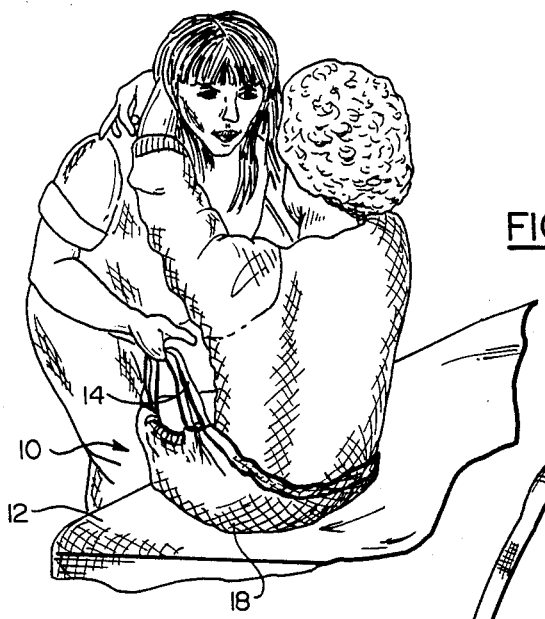
FIG. 1 is a perspective view of a person seated on the device of the invention and being lifted by another individual grasping the flexible handle means of the device in one of the optional positions thereof.

Referring now to the drawings, in FIG. 1 is shown a person seated upon the device of the invention, denoted generally by reference numeral 10, on a supporting surface such as the side of bed 12. The person seated on device 10 is assumed to be physically handicapped or otherwise infirm or impaired, requiring assistance in order to rise from a seated position and to be transferred to a seated position on a support other than bed 12. As shown in FIG. 1, a second individual is standing at the side of bed 12, facing the seated person, and grasping flexible handles on both sides of device 10, one of which is seen in FIG. 1 and denoted by reference numeral 14. The other flexible handle is seen in all other figures.

Device 10 includes a generally rectangular, main body portion 18, of sturdy but flexible cloth, fabric or other such material, having front, rear and side edges 20, 22, 24 and 26, respectively, all of which are preferably hemmed in the usual manner. Rear edge 22 is gathered laterally inward to a length somewhat less than that of front edge 20. Such gathering may be of a permanent nature, by making a plurality of small folds along the marginal portion prior to stitching the hem, or of an expansible and contractable nature, by an elastic band stitched into the hem in known manner. Front edge 20 is also somewhat foreshortened from its original length by making two folds 28 and 30 extending from front edge 20 toward the center of body 18 and stitching the folds adjacent the front edge to insure their permanence. In this manner, the front and rear edges cooperate to form a natural pocket which tends to conform to the body contours of a person seated on body portion 10.

Inwardly adjacent side edge 24 are two longitudinally spaced portions 32 and 34 with central portion 36 lying between and separated from portions 32 and 34 by dividing lines 38 and 40. Portions 32, 34 and 36 are formed in a double layer of the material, outwardly of seam 42 where the material has been stitched to itself after the marginal edge portion has been folded inwardly, upon itself. Thus, portions 32, 34 and 36 form pockets which are open at both ends. A length of strong, flexible material, such as nylon webbing, is passed through the pockets formed by portions 32 and 34, and the ends are overlapped and attached to form a continuous loop, thus providing strap-type handle 14. Handle 16 is provided in like manner on the opposite side, passing through the open pockets of spaced portions 44 and 46 which are separated from central portion 48 by dividing lines 50 and 52, outwardly of seam 54.

Figure 2:
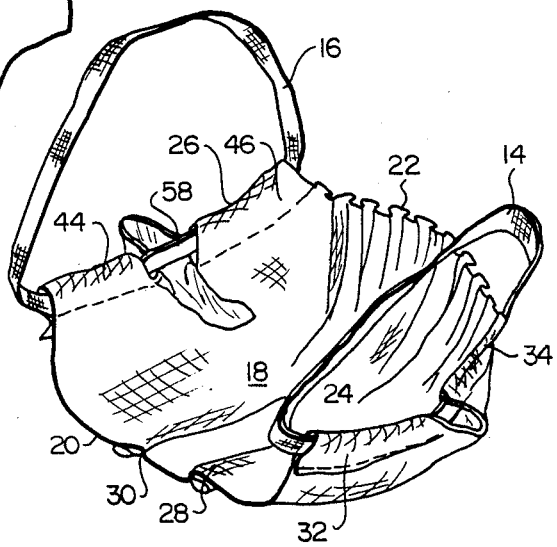
FIGS. 2 and 3 are perspective views of the device, seen from the upper side, showing the flexible handle means in different positions.
Figure 3:
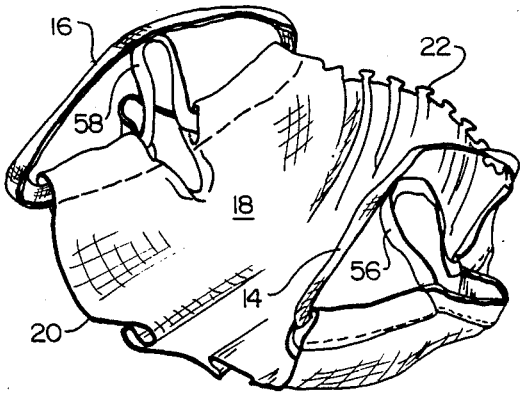
Figure 4:
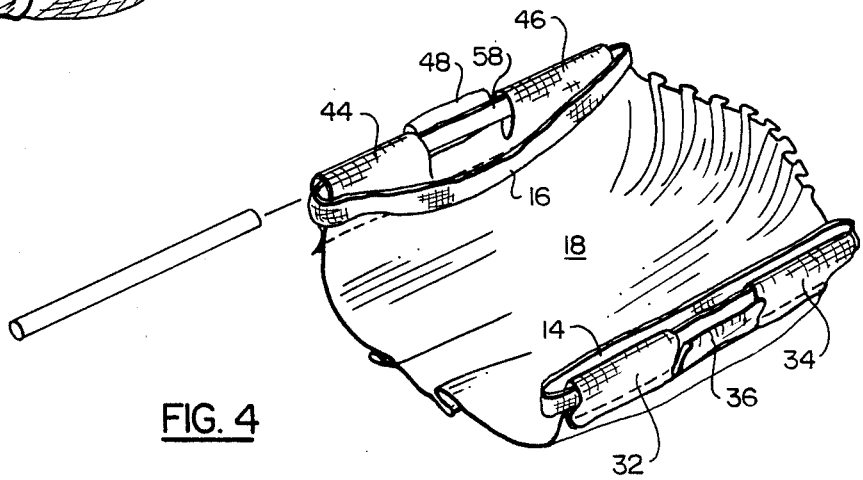
FIG. 4 is a perspective view, as in FIGS. 2 and 3, showing the rigid handle means being placed in the device.
Figure 5:
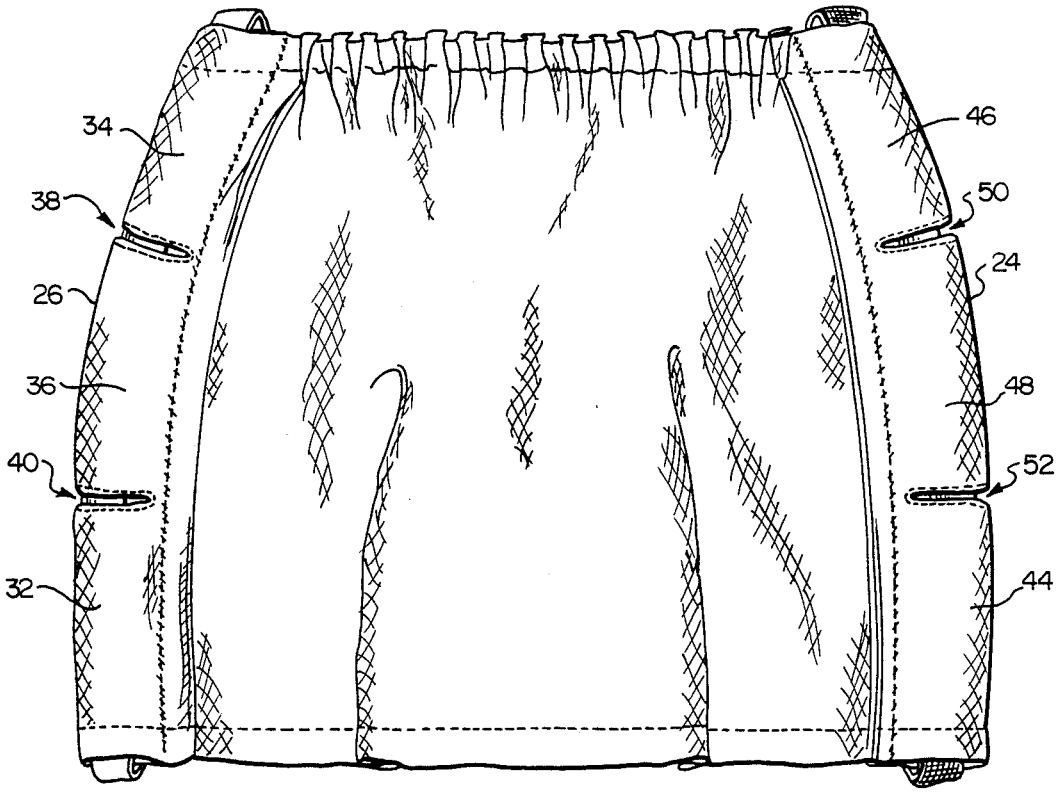
FIGS. 5 and 6 are top and bottom plan views, respectively, of the embodiment of the device shown in FIGS. 1–4.
Figure 6:
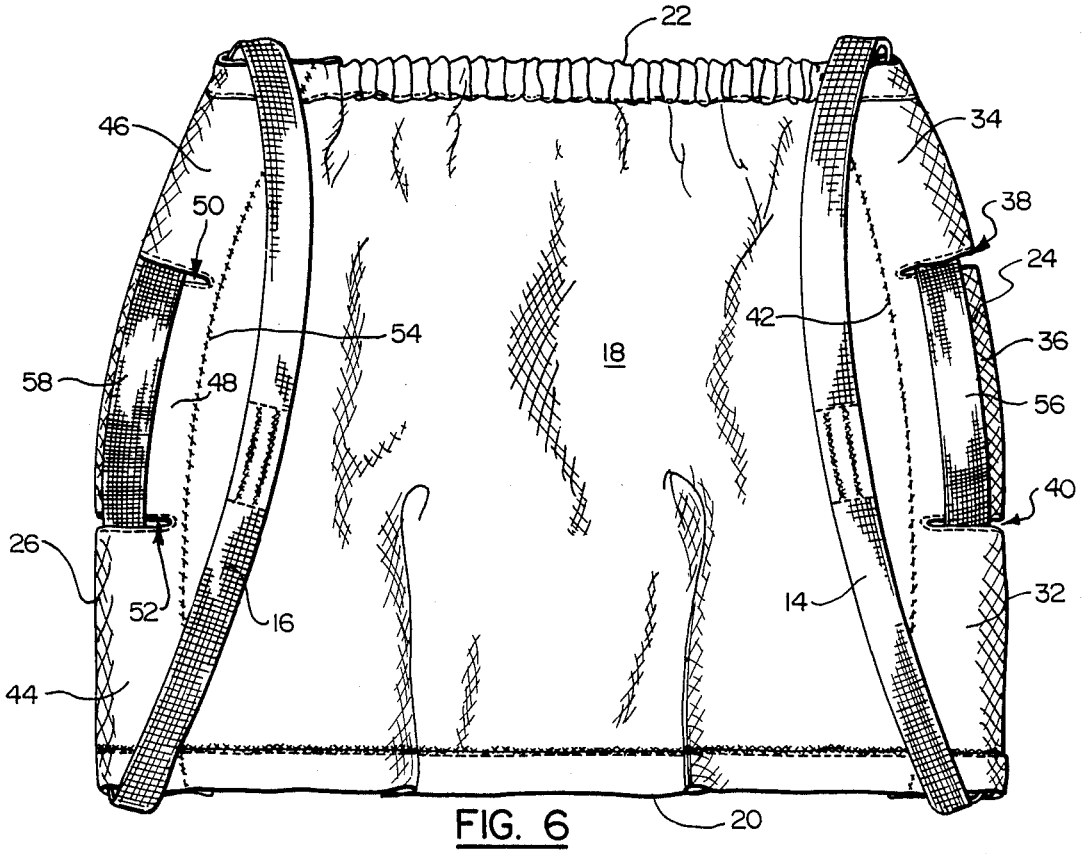

Since the straps forming handles 14 and 16 are not passed through the pocket formed by central portions 36 and 48 (which need not be open at the ends) strap portions 56 and 58 are accessible on the upper sides of central portions 36 and 48. This permits the selective use of handles 14 and 16 in either of two positions. That is, the upper portions of the two straps may be grasped to lift device 10 and a person seated thereon when a longer handle means is desired, as indicated in FIG. 2. Alternatively, portions 56 and 58 may be pulled up to meet the upper portions of the straps and the device lifted while grasping both portions of each strap, thereby providing a shorter handle means, as shown in FIGS. 1 and 3. In situations where a rigid handle means is desired, rods 60 and 62, such as wooden dowels of suitable diameter, may be inserted through the open pockets of portions 32 and 34 adjacent side edge 24, and portions 44 and 46 adjacent side edge 26, as shown in FIG. 4. Central portions of rods 60 and 62 are accessible between portions 32 and 34, and portions 44 and 46 for grasping and lifting.

Figure 7:
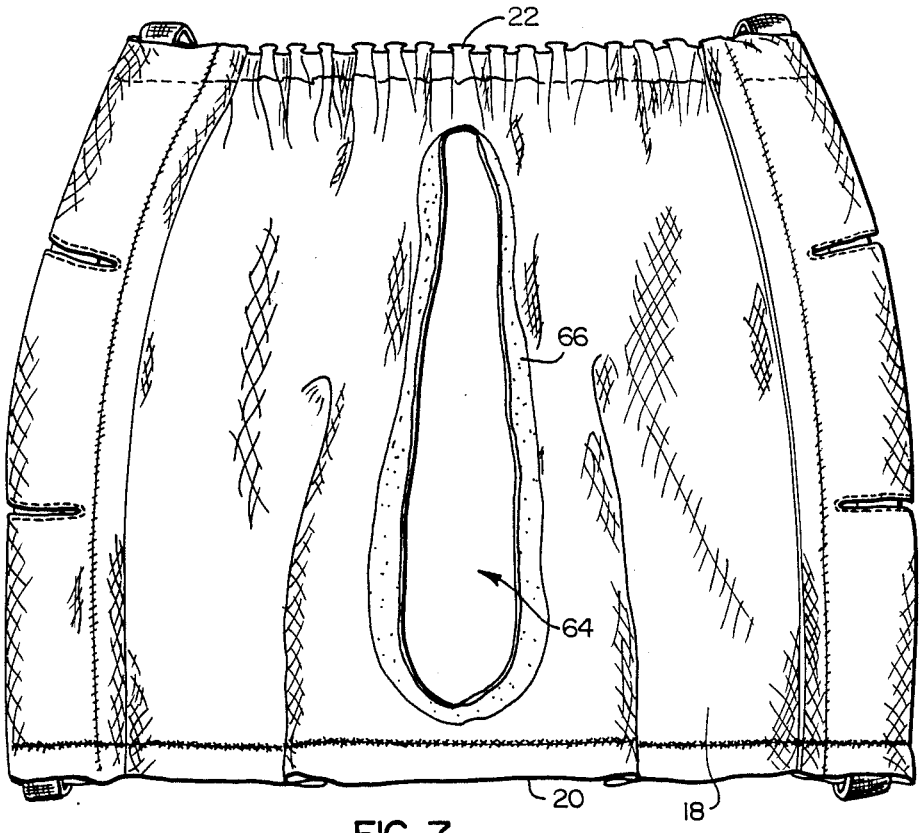
FIGS. 7 and 8 are top and bottom plan views, respectively, of an alternate embodiment of the device.
Figure 8:
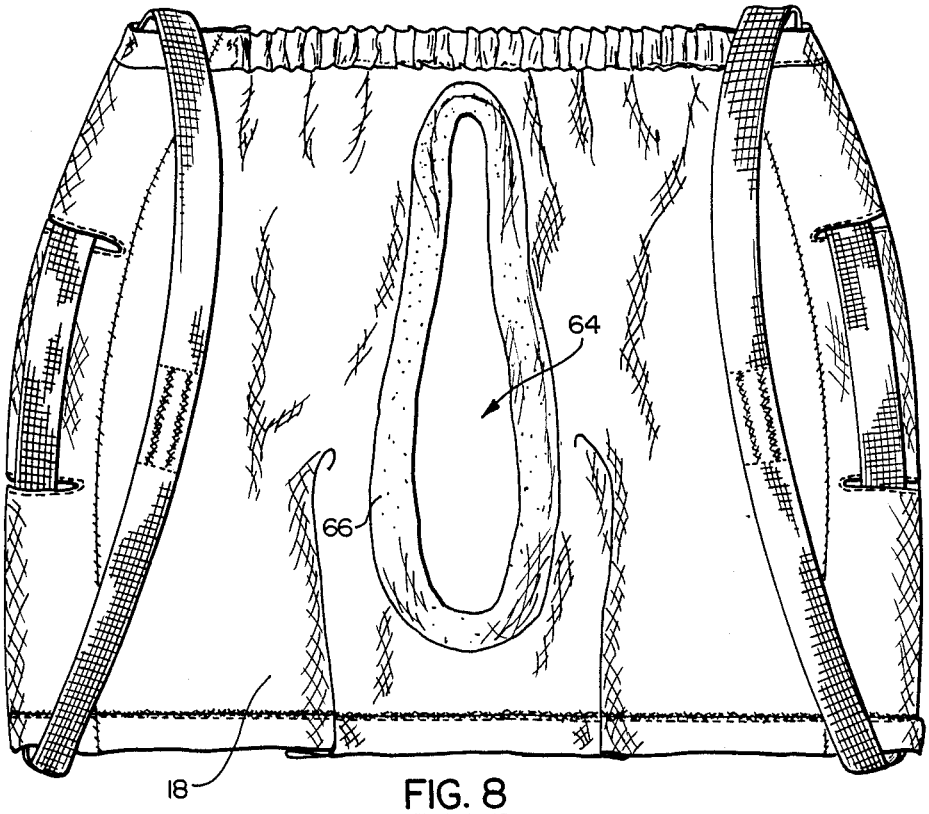

An alternative embodiment of the device is shown in FIGS. 7 and 8. Opening 64, elongated from front to rear, is provided in a central area of body portion 18, surrounded by a suitable binding 66. In all other respects, the device of FIGS. 7 and 8 is the same as that of the previously described embodiment. The provision of opening 64 makes it possible for a person seated on device 10 to be placed on a toilet seat and to use the toilet facilities without being removed from the device.

From the foregoing, it may be seen that the objects of the invention are efficiently and effectively attained in a lifting and support device which is simple and economical in design. A person seated on a supporting surface may easily be placed upon the device either by laying the device on the surface at one side of the person and sliding the person sideways onto the device, or by lifting the person slightly as the device is slid either sideways or forwardly to a position under the seated person. The strap-type, flexible handles may be used in either of two, long or short, positions, and rigid handle means may be used when desired. The lifting action is such that the individual(s) performing the lifting and support are relieved of a great deal of the strain which is associated with such actions when no such device is used.

What is claimed is:

1. A sling-type device for assisting an individual in lifting a handicapped or infirm person from a seated position on a first supporting surface and transferring the person to a sitting position on a second supporting surface, said device comprising:

(a) a main body portion of flexible material having front, rear and right and left side edges;

(b) said material being folded inwardly to form a double layer, and attached to itself in marginal portions along each of said right and left side edges;

(c) a first pair of longitudinally elongated and spaced pockets, each open at both ends, in said double layer, marginal portions along said right side edge;

(d) a second pair of longitudinally elongated and spaced pockets, each open at both ends, in said double layers marginal portions along said left side edge; and (e) first and second elongated, continuous loops of flexible material respectively passing through said first and second pair of pockets, whereby portions of each of said loops are accessible in a space between said longitudinally spaced pockets, said loops providing strap-type handle means adjacent each of said side edges for selective use either in the full length of said loops or in shortened length by drawing said portions of each of said loops through said pockets and doubling said loops upon themselves.

2. The device of claim 1 and further including an opening elongated from front to rear in a central area of said body portion between said front and rear edges.

3. The device of claim 1 and further including first and second elongated rods respectively extending at least partially through said first and second pair of pockets, whereby central portions of each of said rods are accessible in the space between said longitudinally spaced pockets, providing rigid handle means adjacent each of said side edges for alternative use with said strap-type handles.

4. The device of claim 3 wherein said rear edge is shorter than said front edge.

5. The device of claim 4 wherein said rear edge is shortened by gathering along substantially its entire length.

6. The device of claim 4 wherein said body portion includes a pair of permanent fold lines extending from said front edge rearwardly for about one-half the distance to said rear edge, whereby said body portion conforms naturally to the body contours of a person supported by said device.

7. The device of claim 6 and further including first and second elongated central portions respectively positioned between the two pockets of each of said first and second pairs and separated therefrom by dividing lines extending inwardly from said side edges through both layers of material in said double layer, marginal portions.

8. The device of claim 7 wherein each of said pockets and said central portions are of substantially the same length.

* * * * *